US008182164B2

(12) United States Patent
Yaguchi

(10) Patent No.: US 8,182,164 B2
(45) Date of Patent: May 22, 2012

(54) PRINTING APPARATUS AND PRINT SETTING METHOD

(75) Inventor: Hiroyuki Yaguchi, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 12/468,546

(22) Filed: May 19, 2009

(65) Prior Publication Data

US 2009/0297247 A1 Dec. 3, 2009

(30) Foreign Application Priority Data

May 30, 2008 (JP) ..... 2008-143616

(51) Int. Cl.
*B41J 11/00* (2006.01)

(52) U.S. Cl. ..... 400/621; 400/621.1; 400/621.2

(58) Field of Classification Search ..... 400/621
See application file for complete search history.

(56) References Cited

U.S. PATENT DOCUMENTS 6,249,301 B1 6/2001 Kawamura et al.
2001/0000222 A1* 4/2001 Miyazaki et al. ..... 400/621
2002/0180859 A1* 12/2002 Yoshida ..... 347/171
2005/0078325 A1* 4/2005 Momose et al. ..... 358/1.9
2005/0168566 A1* 8/2005 Tada et al. ..... 348/14.01
2007/0256780 A1* 11/2007 Gilmour ..... 156/268

FOREIGN PATENT DOCUMENTS

JP 2001-088385 4/2001

* cited by examiner

*Primary Examiner* — Michael G Lee
*Assistant Examiner* — Laura Gudorf
(74) *Attorney, Agent, or Firm* — Cowan, Liebowitz & Latman, P.C.

(57) ABSTRACT

A printing apparatus which prints one image by sequentially transferring a set of a plurality of color inks to roll paper from an ink ribbon cyclically coated with the plurality of color inks, the apparatus comprising: an acquisition unit which acquires image data; a print processing unit which prints an image on the roll paper based on the image data acquired by the acquisition unit; a cutting unit which cuts the roll paper after the print processing unit prints the image; and a setting unit which sets a cutting position, the setting unit displaying an image to be printed on a display unit together with the cutting position, and changing the cutting position in accordance with an operation to an operation member, wherein the cutting unit cuts the roll paper in accordance with the cutting position set by the setting unit.

16 Claims, 13 Drawing Sheets

PRINTING APPARATUS AND PRINT SETTING METHOD

BACKGROUND OF THE INVENTION

1. Field of the Invention

The present invention relates to a printer which prints an image on roll paper and cuts the roll paper after printing, and a print setting method.

2. Description of the Related Art

Along with recent development of image input devices including a digital camera, digital video camera, and cell phone, a variety of image processing apparatuses having an image display means for sensed image data, and a printout means have been commercialized. An example of the image processing apparatuses is a photo printer.

Most photo printers used to print out image data such as a photograph shot by an image input device adopt printing methods such as the inkjet method and thermal transfer method.

According to the inkjet method, small ink droplets are applied by an impact, heating, or the like. Small ink droplets land on paper to obtain a desired resolution and tonality by an error diffusion method or the like. Typical methods for applying ink are a piezoelectric method and thermal inkjet method. The piezoelectric method pushes out ink using a piezoelectric element which deforms upon application. The thermal inkjet method applies ink by pressurizing it by bubbles generated by a heating element.

The thermal transfer printer uses thermal paper (paper having a dye receiving layer on the surface) as print paper. The thermal transfer printer selectively drives a plurality of thermal heads arrayed in the main scanning direction, conveys paper in the sub-scanning direction, and prints a dot line on the paper.

A sublimation thermal transfer printer brings a ribbon of ink, which sublimates from solid to gas, into contact with paper. This printer can express a smooth image at many tone levels by controlling the amount of heat applied to the head and the application count to change the density of one pixel. Thus, the sublimation thermal transfer method is suited to print out a photograph.

The thermal transfer printer generally uses an ink ribbon having a structure shown in FIG. 2. Yellow (Y), magenta (M), and cyan (C) sublimation dye layers 201, 202, and 203 for forming an image are sequentially formed on the base of an ink ribbon. An overcoat layer (heat-fusion resin clear layer) 204 for protecting an image forming layer is finally formed. Markers 205 for detecting the start position of an ink ribbon are interposed between the ink ribbon layers of the respective colors and between the ink ribbon layer and the overcoat layer (double markers are arranged as the Y marker). Note that a spot color ink ribbon dedicated to monochrome image printing or the like has a different structure.

To form one image, paper sequentially undergoes thermal transfer processing using a set of the three, Y, M, and C dye layers and the overcoat (OC) layer serving as a protective layer. On an ink ribbon contained in an ink ribbon cartridge, the Y, M, and C layers and OC layer are repetitively arranged by the number of printable sheets. In general, the ribbon made up of the Y, M, and C layers and OC layer is set to have a length capable of printing at the longitudinal size of print paper.

Print paper sheets of various sizes and materials are used depending on printer apparatuses. A thermal transfer printer mainly uses roll paper for business use. Another popular printer apparatus using roll paper is one for creating a label tape. Paper used in a printer apparatus of this type includes a general print tape, and a tape obtained by superposing release paper and a print tape whose lower surface is formed from an adhesive sheet. After the end of printing on a print tape, the print tape is cut into a set length (Japanese Patent Laid-Open No. 2001-088385).

However, a sublimation printer which prints using an ink ribbon coated with a sublimation ink automatically determines the cutting position of roll paper in accordance with the size of an ink ribbon attached to the printer, a paper size corresponding to the ink ribbon, or the paper size setting. This printer does not provide a means for allowing the user to freely set the cutting position and cutting method of roll paper when printing image data on the roll paper.

SUMMARY OF THE INVENTION

The present invention has been made in consideration of the aforementioned problems, and attains a printer capable of setting the cutting position and cutting method of roll paper when printing an image on the roll paper.

In order to solve the aforementioned problems, there is provided a printing apparatus which prints one image by sequentially transferring a set of a plurality of color inks to roll paper from an ink ribbon cyclically coated with the plurality of color inks, the apparatus comprising: an acquisition unit which acquires image data; a print processing unit which prints an image on the roll paper based on the image data acquired by the acquisition unit; a cutting unit which cuts the roll paper after the print processing unit prints the image; and a setting unit which sets a cutting position, the setting unit displaying an image to be printed on a display unit together with the cutting position, and changing the cutting position in accordance with an operation to an operation member, wherein the cutting unit cuts the roll paper in accordance with the cutting position set by the setting unit.

There is also provided a print setting method in a printing apparatus which prints one image by sequentially transferring a set of a plurality of color inks to roll paper from an ink ribbon cyclically coated with the plurality of color inks, the method comprising: an acquisition step of acquiring image data; a setting step of displaying an image to be printed on a display unit together with a cutting position, and changing the cutting position in accordance with an operation to an operation member; a print processing step of printing an image on the roll paper based on the acquired image data; and a cutting step of causing a cutting unit to cut the roll paper in accordance with the set cutting position after printing the image.

According to the present invention, the user can set the cutting position of roll paper when printing an image on the roll paper.

Further features of the present invention will become apparent from the following description of exemplary embodiments with reference to the attached drawings.

DESCRIPTION OF THE EMBODIMENTS

Embodiments of the present invention will be described in detail below with reference to the accompanying drawings.

The following embodiments are merely examples for realizing the present invention. The embodiments should be properly modified or changed depending on various conditions and the structure of an apparatus to which the present invention is applied, and the present invention is not limited to the following embodiments.

Figure 3:
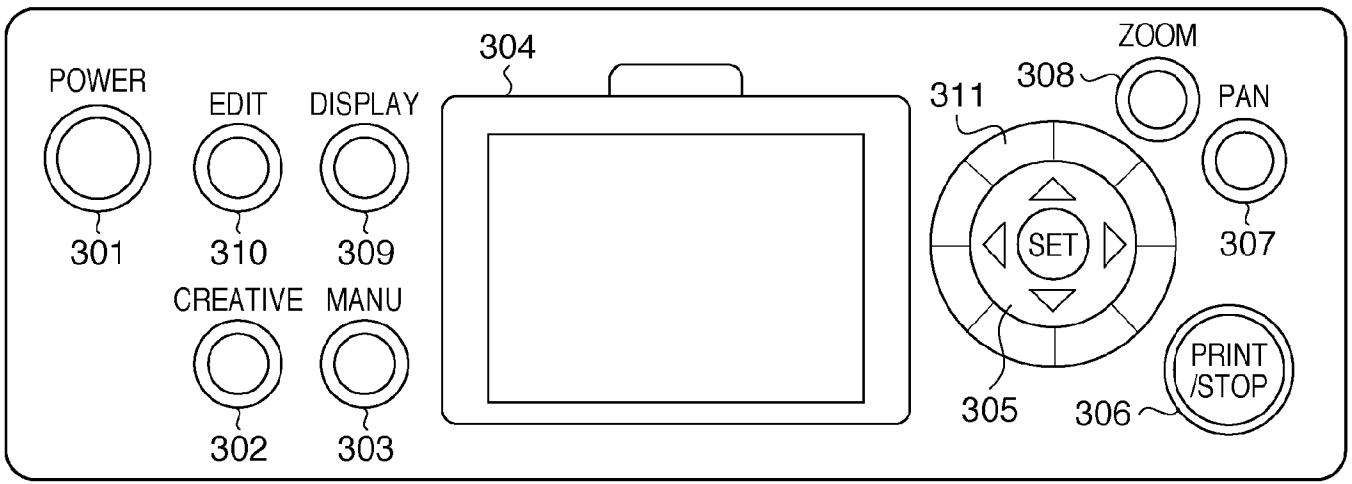
FIG. 3 is a view showing the operation member of the printer apparatus according to the embodiment.

FIG. 3 is a view showing the operation member of a printer apparatus according to an embodiment.

The operation member includes a power button 301 for designating the power ON/OFF operation of the printer apparatus, and a liquid crystal display screen 304 for displaying a printing GUI. The operation member also includes a four-way selector key/SET button 305 and jog dial 311 which are used to make various settings and select an item and image. Further, the operation member includes a print/stop button 306 for designating the start/stop of print processing.

Figure 4:
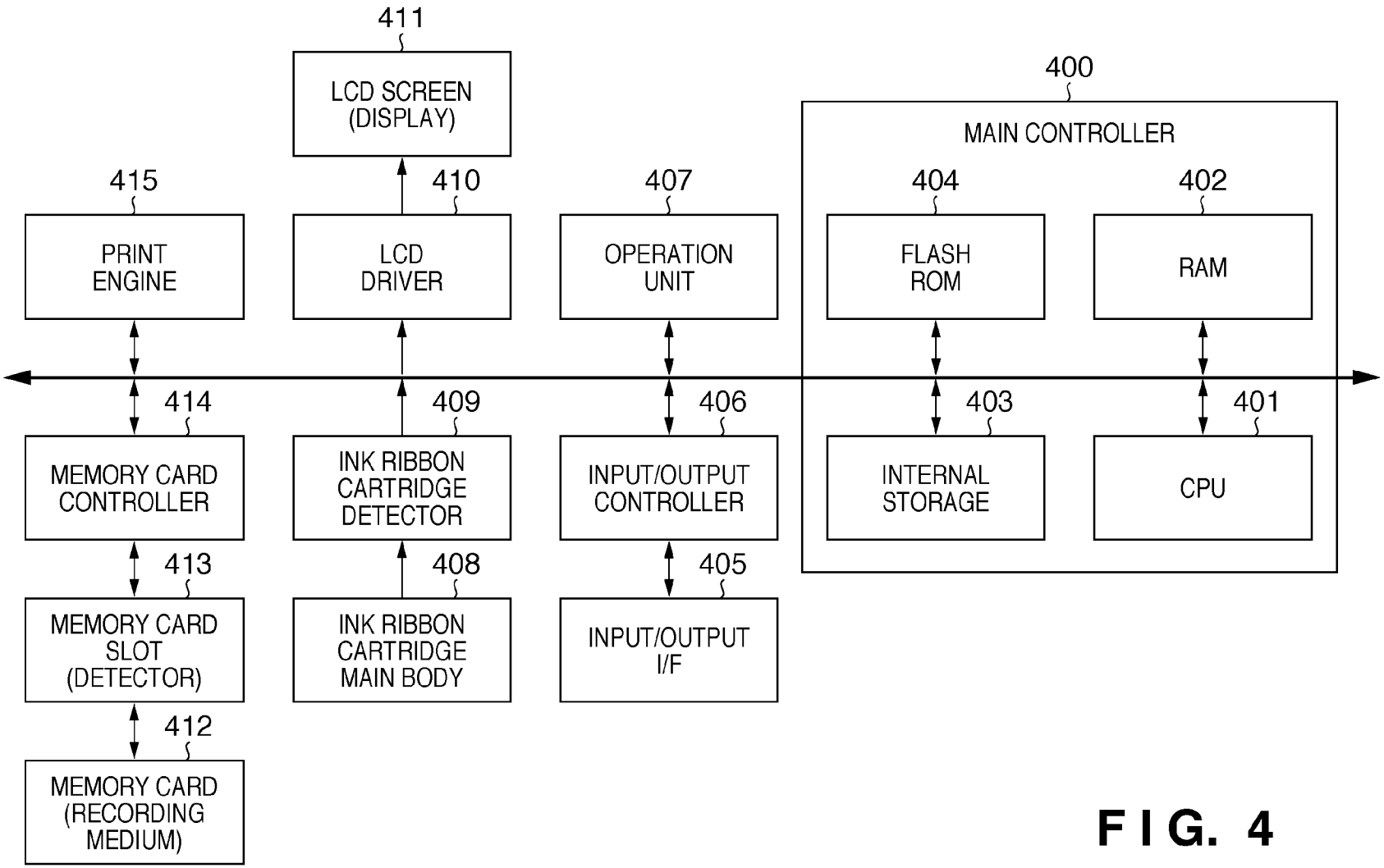
FIG. 4 is a block diagram showing the schematic arrangement of the printer apparatus according to the embodiment.

FIG. 4 is a block diagram showing the schematic arrangement of the printer apparatus according to the embodiment.

Respective units in the block diagram shown in FIG. 4 will be explained.

A main controller 400 serving as the core of the system configuration of the printer apparatus includes a CPU 401, RAM 402, internal storage 403, and flash ROM 404.

The CPU 401 controls the system of the printer apparatus, and executes arithmetic processes complying with a variety of programs. The CPU 401 performs resizing processing and color conversion processing for image data, and also executes processing for generating print data. The RAM 402 is used as a temporary storage for image data, and also as a work area for image resizing processing, conversion processing, and the like. The flash ROM 404 saves system control programs and various parameters. The internal storage 403 includes an HDD (Hard Disk Drive) and flash memory, and is used to save an image file. The CPU 401 reads out a program from the flash ROM 404, and executes control and processing based on the readout program.

An input/output I/F 405 is an interface for connecting an external device such as a digital camera or PC, and is a USB connector terminal or the like. An input/output controller 406 controls the I/F 405.

While confirming processing contents via a GUI displayed on an LCD screen (display) 411, the user operates an operation unit 407. An LCD driver 410 controls display processing on the LCD screen 411. The printer apparatus includes a memory card slot (detector) 413, and a memory card controller 414 which reads out image data from a memory card 412 and transfers it to the main controller.

A print engine 415 performs print processing of image data on the surface of print paper. The print engine 415 includes a driving mechanism formed from a thermal head and paper conveyance stepping motor, and a feed/discharge mechanism for feeding and discharging paper. In addition, the printer apparatus includes a cartridge 408 which contains an ink ribbon, and a cartridge detector 409 which detects the type of cartridge. The printer apparatus includes an attaching portion capable of detaching a cartridge. The attaching portion allows attaching cartridges corresponding to various paper sizes. The cartridge detector determines the presence/absence of a cartridge and its type.

Although not shown, the printer apparatus incorporates a power supply circuit for supplying power necessary for an operation, various ICs, a circuit board which supports electrical elements, and the like.

The user presses the power button 301 to turn on the printer apparatus. The memory card controller 414 reads out image data from the memory card 412, and the liquid crystal display 304 displays the readout image. The user can select image data and make various settings by operating the four-way selector key/SET button 305. The user can perform an image data feed operation, scroll operation, and menu selection operation by rotating the jog dial 311.

When the user presses a menu button 303, the liquid crystal display 304 displays a print sheet count setting window and paper type setting window. When the user presses an edit button 310 while the image is displayed, the display changes to an image data trimming edit window. The user can change the trimming size of image data by operating a zoom button 308 and pan button 307. The user presses a display button 309 to switch between display and non-display of information such as the file name, shooting date, and image size of image data. When the user presses a creative print button 302, the display changes to an edit function setting window for calendar creation and multi-layout creation (for laying out a plurality of image data side by side).

Upon completion of selecting image data to be printed and setting print conditions, the user presses the print/stop button 306 to start print processing. To stop print processing after the start of it, the user presses the print/stop button 306 to stop the print processing.

Image data can be acquired by reading it out from the memory card 412 inserted into the memory card slot 413. Also, image data can be acquired from an external device connected via the input/output I/F 405. That is, the printer apparatus can acquire, via a USB cable or the like, image data held in an external device such as a digital camera, generate print data from the acquired image data, and execute print processing. In this case, the printer apparatus serves as a host, and the digital camera serves as a device. The printer apparatus and digital camera are connected and communicate with each other. The user can perform a print operation from the digital camera. Alternatively, the printer apparatus serves as a device, and the PC serves as a host. The printer apparatus and PC are connected and communicate with each other. The user can perform a print operation from the PC.

Figure 5:
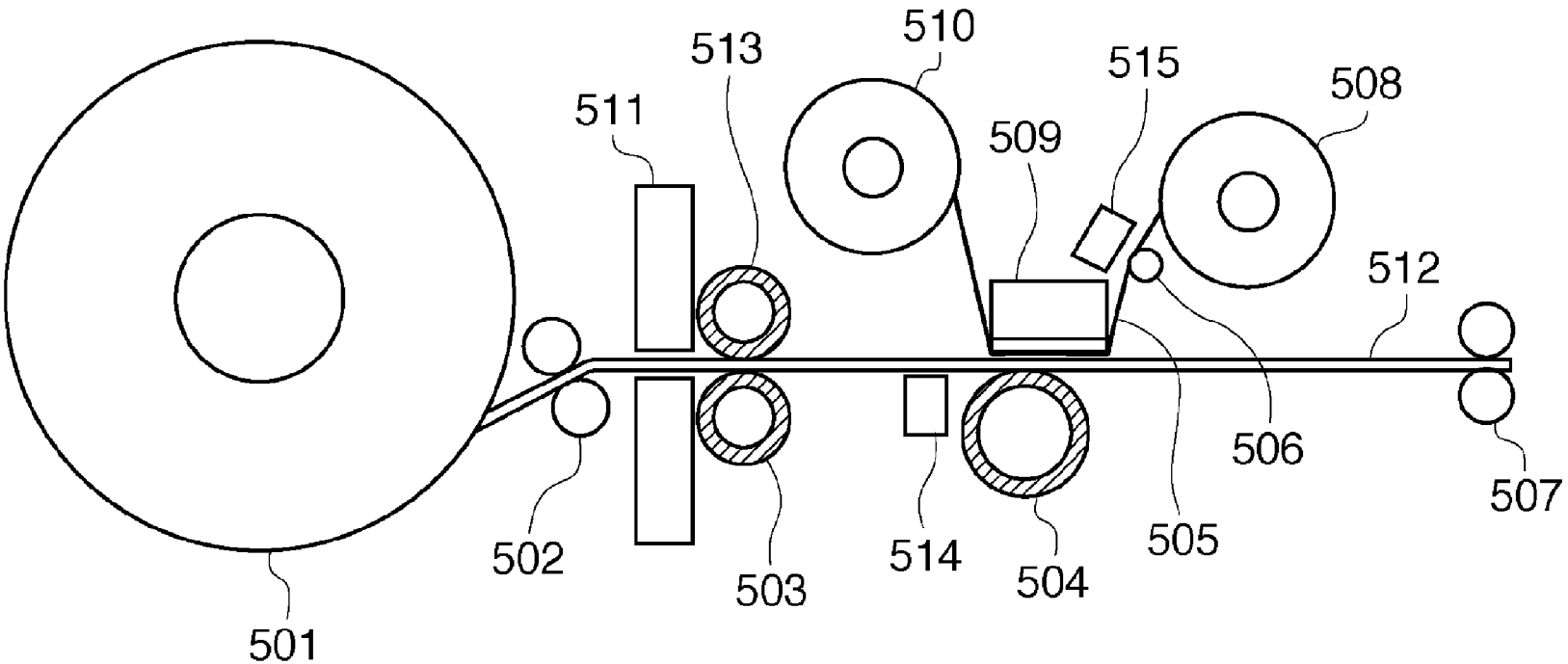
FIG. 5 is a sectional view showing the schematic structure of the engine of the printer apparatus according to the embodiment.

FIG. 5 is a sectional view showing the schematic structure of the engine which performs print processing in the printer apparatus according to the embodiment.

Referring to FIG. 5, the container contains roll paper 501. Pickup rollers 502 pull the leading end of the roll paper 501 from the container. The roll paper 501 is fed to a grip roller 503 controlled by a stepping motor. A pinch roller 513 is arranged to face the grip roller 503. While the grip roller 503 and pinch roller 513 pinch roll paper 512, the roll paper 512 is conveyed by rotating the grip roller 503. The roll paper 512 is conveyed from the grip roller 503 to a platen roller 504 and discharge rollers 507 along the conveyance path.

A thermal head 509 is arranged to face the platen roller 504. An ink ribbon 505 passes between the thermal head 509 and the pulled roll paper 512. A roll bobbin 510 on the ink ribbon supply side supplies the ink ribbon 505. The supplied ink ribbon passes between the thermal head 509 and the pulled roll paper 512, and is wound around a roll bobbin 508 on the ink ribbon winding side, winding around which is controlled by driving a DC motor. An ink ribbon guide roller 506 is arranged to smoothly convey the ink ribbon 505.

The ink ribbon 505 is formed by cyclically applying, onto a sheet, yellow (Y), magenta (M), and cyan (C) sublimation dye ink layers, and a heat-fusion resin clear layer (OC layer) for forming a protective layer. Markers for detecting the start position of an ink ribbon are interposed between the various ink ribbon layers. The respective color inks are applied to the ink ribbon at the same size.

In a print operation, the platen roller 504 presses the roll paper 512 against the thermal head 509. The ink ribbon 505 comes into contact with the heating element of the thermal head 509 and the roll paper 512. The CPU 401 drives the heating element of the thermal head 509 in synchronism with paper conveyance by the stepping motor. The heating element is driven to generate heat. The heat allows sequentially transferring a set of inks of the respective colors (Y, M, and C) on the ink ribbon 505 onto the pressed roll paper 512, forming an image. At the same time, the DC motor driven and controlled by the CPU 401 causes the roll bobbin 508 on the ink ribbon winding side to wind the ink ribbon 505, supplying an unused part of the ink ribbon to the heating element of the thermal head 509.

After the end of sequentially applying the Y, M, and C inks to print one image, the heat-fusion resin clear layer (OC layer) is fused by heat of the heating element of the thermal head 509, coating the surface of roll paper. After the end of printing with Y, M, C, and OC, a paper cutting mechanism 511 cuts the roll paper 512 into a desired size. The discharge rollers 507 discharge the printed roll paper 512 from the apparatus. The paper cutting mechanism 511 can execute the following three cutting methods:

(1) Full-cutting (to completely cut paper)

(2) Half-cutting (to incise roll paper by cutting only one side of the paper without completely cutting it: for example, for seal paper, only a seal surface is cut without cutting a release paper adhered to the adhesive surface of seal paper.)

(3) Perforation cutting (to perforate paper at equal intervals so that the user can cut it off)

[First Embodiment]

Print settings and print processing in a printer apparatus according to the first embodiment of the present invention will be explained.

Figure 1:
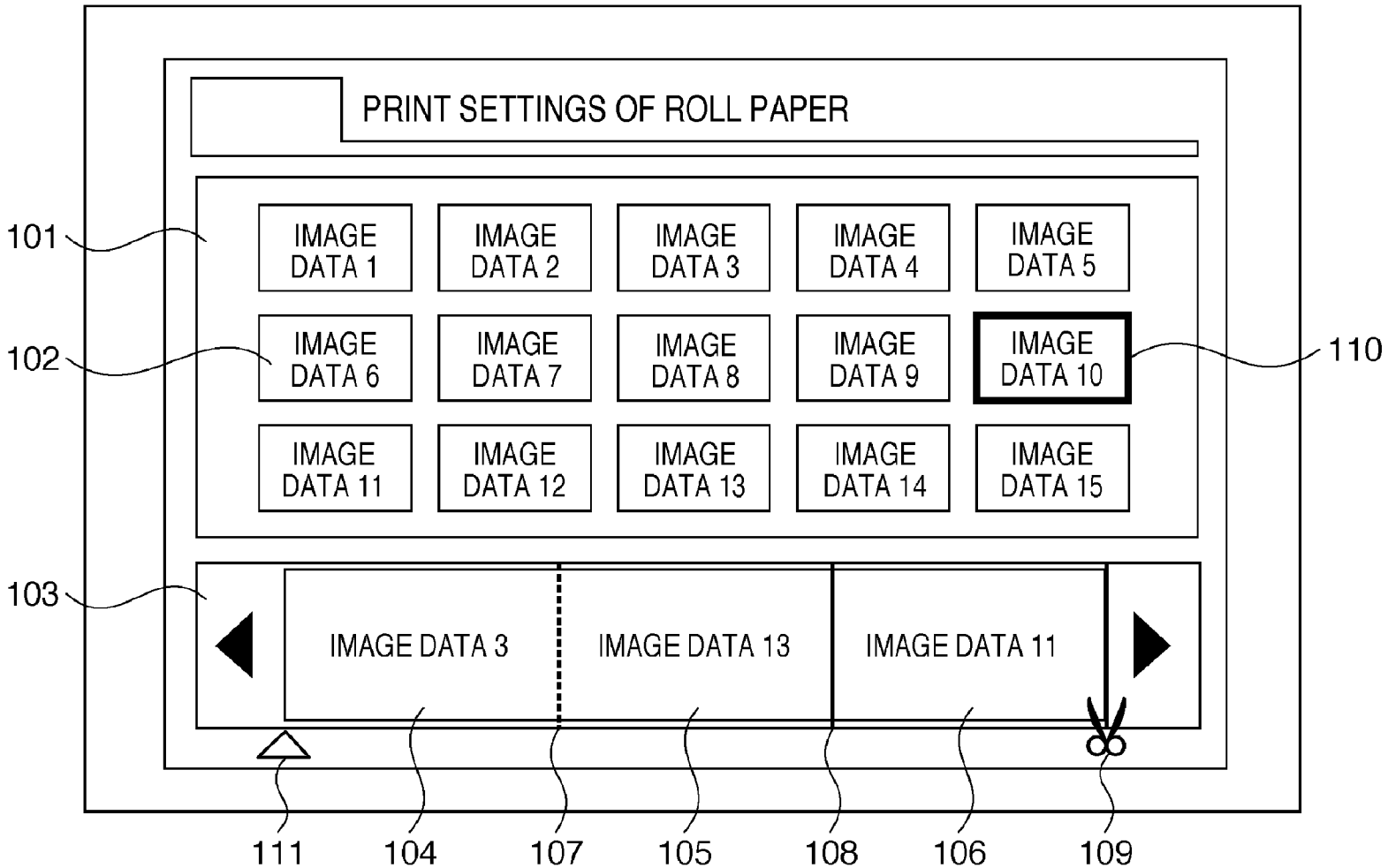
FIG. 1 is a view exemplifying a roll paper print setting window in a printer apparatus according to the first embodiment.
Figure 2:
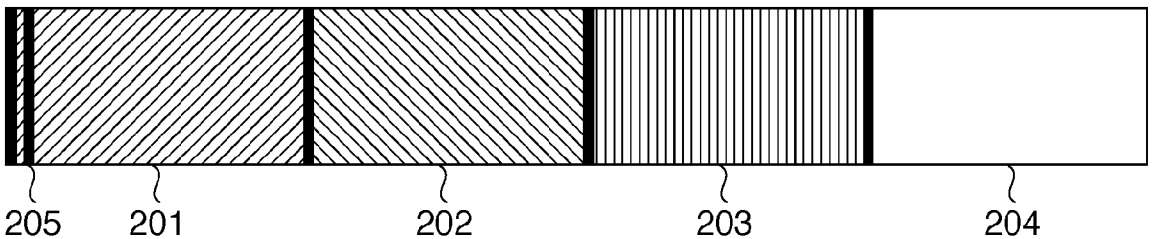
FIG. 2 is a view showing the structure of an ink ribbon used in the printer apparatus according to the embodiment.
Figure 6:
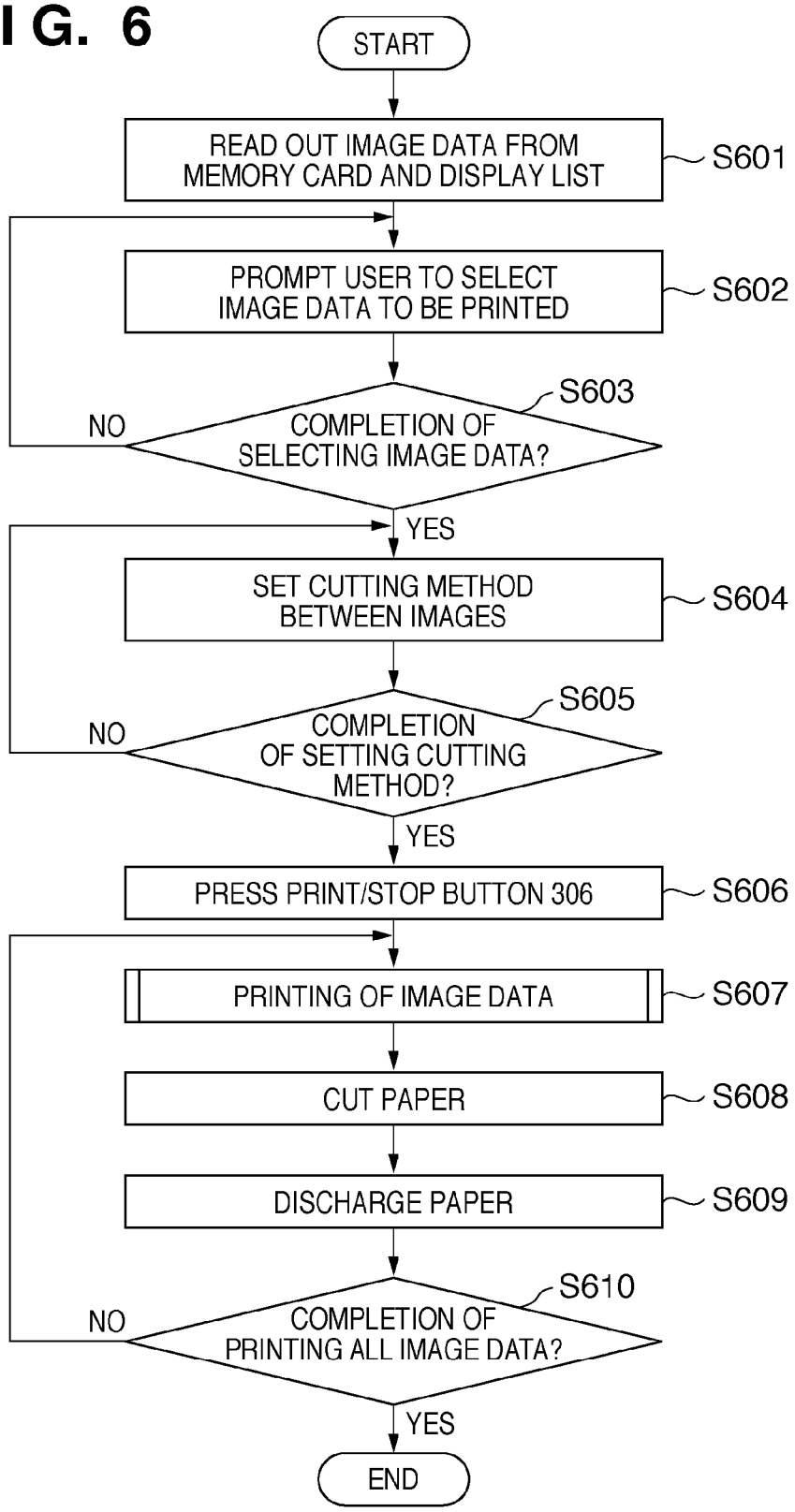
FIG. 6 is a flowchart showing print setting processing by the printer apparatus according to the first embodiment.
Figure 7:
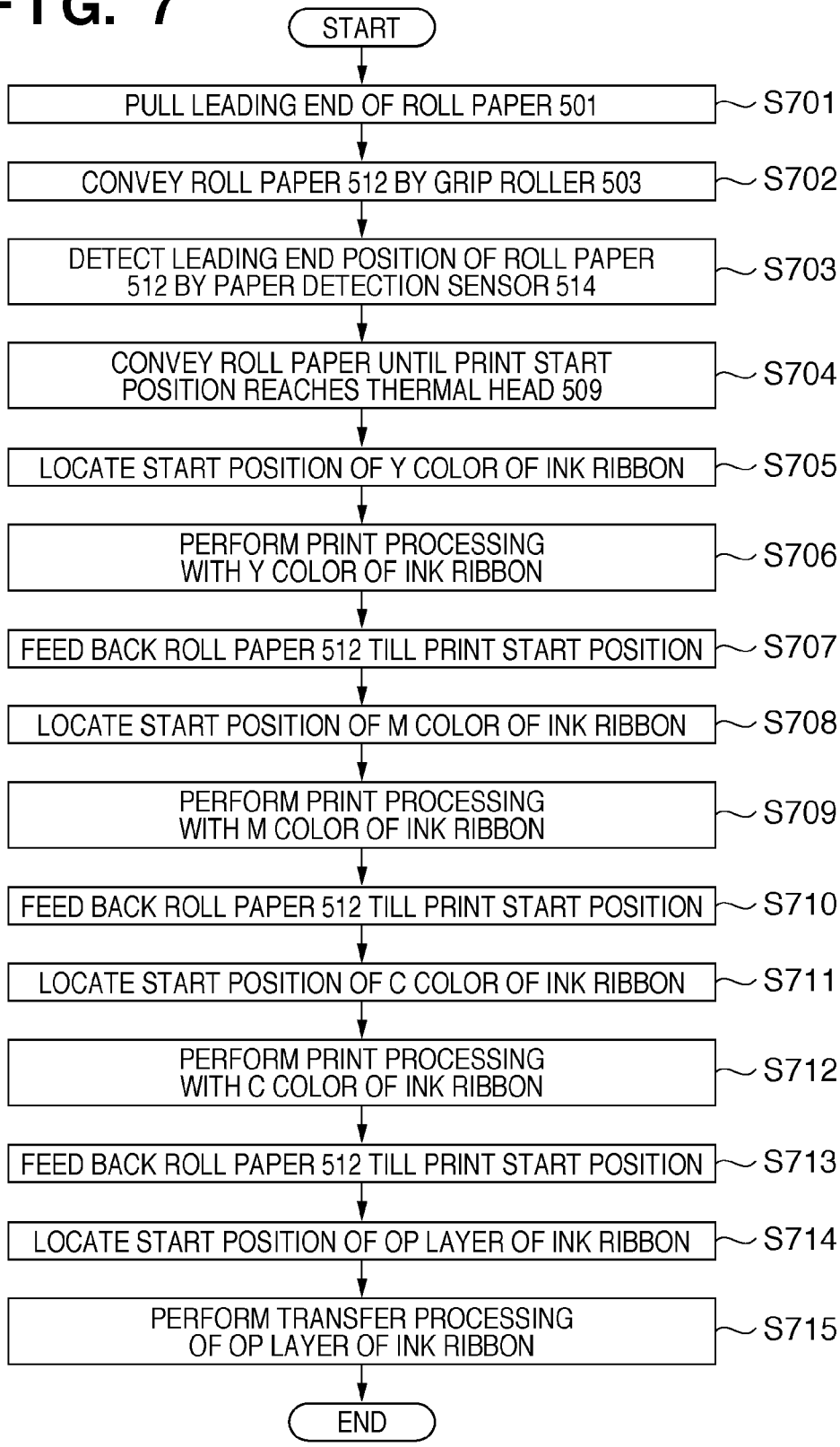
FIG. 7 is a flowchart showing print processing by the printer apparatus according to the first embodiment.
Figure 8:
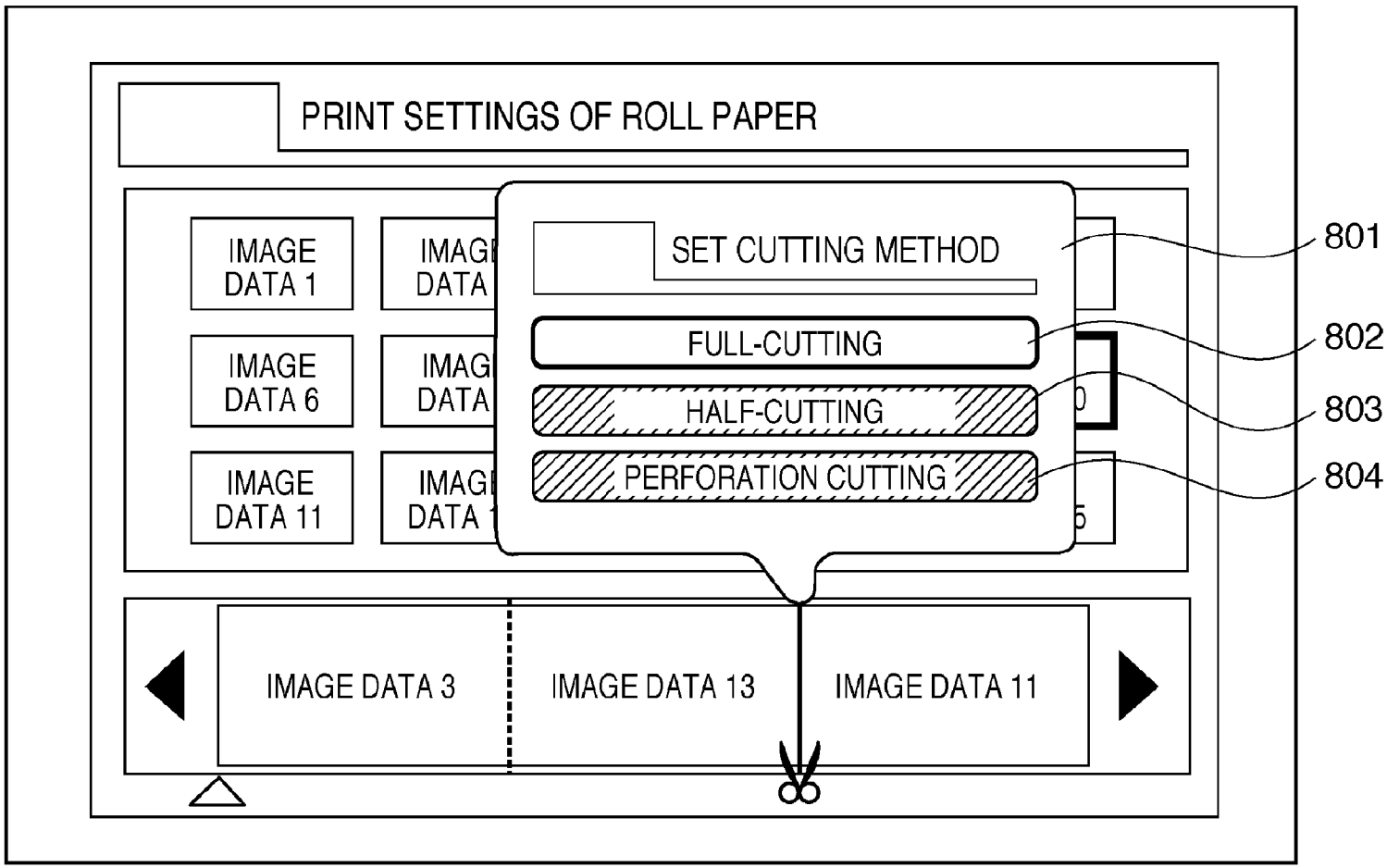
FIG. 8 is a view exemplifying a cutting method setting method when making the print settings of roll paper in the printer apparatus according to the first embodiment.

FIGS. 6 and 7 are flowcharts showing print processing by the printer apparatus according to the first embodiment. FIGS. 1 and 8 exemplify GUIs displayed on an LCD screen when executing processing shown in the flowchart of FIG. 6.

When the user selects "print settings of roll paper" from the menu of the print setting window, image data is read out from a memory card 412. An image data list display window 101 displayed on an LCD screen 411 displays a list of the arrayed thumbnails of image data (S601).

The user moves a selection cursor 110 by operating a four-way selector key 305 or jog dial 311 of the UI operation member. The user selects image data to be printed from images displayed in the image data list display window 101 (S602).

By pressing the SET button 305, the user finalizes an image to be printed. A print image display window 103 additionally displays the selected image data. The print image display window displays images in the order and form of actual printing on roll paper when executing printing. An addition position cursor 111 moves right and left in accordance with an operation to the four-way selector key 305 or jog dial 311 of the UI operation member. An image to be printed is added to the position of the addition position cursor 111. By moving the addition position cursor 111 and then selecting an image to be printed, the user can adds the image at a position he wants. In FIG. 1, the addition position cursor 111 is positioned on the left side of image data 3. If the user selects an image in this state, the image is added to the left side of image data 3.

In the GUI of FIG. 1, image data 3, image data 13, and image data 11 are selected as printing targets, and displayed in areas 104, 105, and 106 in the print image display window 103.

Upon completion of selecting image data (YES in S603), the user sets a cutting method between image data in the print image display window 103 for image data to be printed on roll paper (S604).

The GUI in FIG. 1 shows a setting example of the cutting method. In FIG. 1, a dotted line 107 is displayed at the boundary between image data 3 and image data 13 to represent a perforation cut setting. A solid line 108 is displayed at the boundary between image data 13 and image data 11 to represent a half-cut setting. A solid line and scissors mark are displayed on the right side of image data 11 to represent a full-cut setting. In this manner, the cutting position and cutting method are explicitly indicated by signs, figures, or characters on an image in the print image display window 103. None of the signs, figures, and characters is displayed at an uncut position without setting a cutting method. When image data 11 is image data to be printed finally, the printer apparatus may also automatically determine the full-cut setting on the right side of image data 11, that is, at the trailing end of image data 11 to be printed finally, so as to inhibit a change to another setting in order to prevent a printed image from remaining connected to roll paper.

The GUI in FIG. 8 exemplifies a cutting method setting window. By operating the jog dial 311, the user can move the cut setting position right and left and select, for example, a cutting position outside the printable area. By pressing the right/left button of the four-way selector key 305, the user can move the cut setting position to the closest image boundary or a position where the cutting method has already been set. In the first embodiment, the cut setting position is moved and displayed in accordance with an operation to the jog dial while fixing the image display. Instead, the image display position may also be moved in accordance with an operation to the jog dial while fixing the cutting position display.

After selecting the cutting position, a cutting method setting display window 801 appears in response to press of the SET button 305. The window presents a full-cut setting button 802, half-cut setting button 803, and perforation cut setting button 804 so as to be able to select one of them. By pressing the up/down button of the four-way selector key 305, the user selects a cutting method from full-cutting, half-cutting, and perforation cutting. The user sets the cutting method with the SET button 305.

Figure 9:
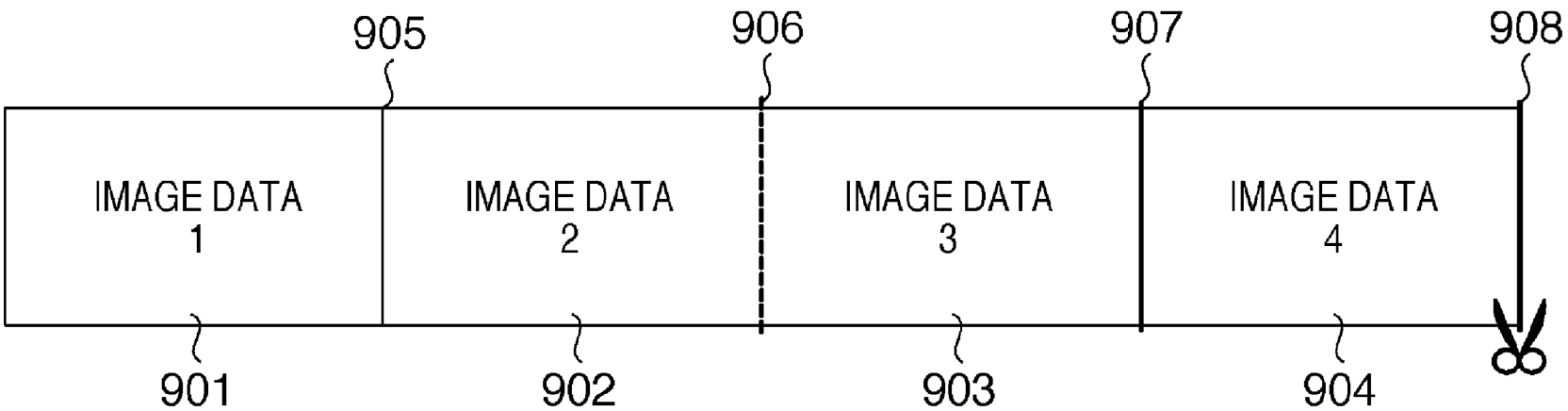
FIG. 9 is a view exemplifying the print settings of roll paper according to the first embodiment.

In the first embodiment, the printer apparatus incorporates card (C)-size seal paper (seal paper is formed by a seal whose lower surface is formed from an adhesive surface, and release paper adhered to the adhesive surface). Assume that print settings as shown in FIG. 9 are made.

Image data 1, image data 2, image data 3, and image data 4 are selected as image data to be printed. It is set to print image data 1, 2, 3, and 4 in the order named. As the cutting method, no setting 905 is made between image data 1 and image data 2. A perforation cut setting 906 is made between image data 2 and image data 3. A half-cut setting is made between image data 3 and image data 4. A full-cut setting is made between image data 4 and the next adjacent image data. If there is no next adjacent image data, the CPU may also automatically set full-cutting and inhibit change of the setting. Alternatively, if the user performs an operation for change, the LCD may also display a warning. If full-cutting is hardly executed in continuously printing a plurality of images, the images are conveyed while being connected.

A thermal printer conveys paper in both forward and backward directions to print images in a print operation. If paper is conveyed while many images are connected, a part of the paper that is discharged from the printer may be damaged. To prevent this, the half-cutting and perforation cutting counts except for the full-cutting count may also be limited in accordance with the number of print sheets by, for example, inhibiting a setting other than full-cutting for five or more successive images. The half-cutting and perforation cutting counts which can be set continuously may also be changed in accordance with the paper size or ink ribbon size.

Upon completion of all the cutting method settings (YES in S605), the user presses the print/stop button 306 (S606), starting print processing. The image data print processing in S607 will be explained with reference to the flowchart of FIG. 7.

Referring to FIG. 7, while pinching the leading end of roll paper 501, pickup rollers 502 are driven to rotate and pull the leading end of the roll paper 501 from the container. The roll paper 501 is conveyed to a grip roller 503 and pinch roller 513 (S701). The grip roller 503 driven and controlled by a stepping motor conveys the paper (S702). The stepping motor rotates by the number of steps of a pulse signal sent from a CPU 401. After the paper detection sensor detects the leading end of the roll paper 501, position control is done in accordance with an open loop. The printer apparatus in the first embodiment performs 0.0845-mm paper conveyance for three steps of the pulse signal.

A paper detection sensor 514 detects the leading end of the paper conveyed by the grip roller 503 (S703). Paper conveyance is executed by a distance corresponding to a predetermined number of steps to convey roll paper 512 to the print start position (S704). A roll bobbin 508 on the ink ribbon winding side winds the ink ribbon to locate the start position of the Y color. A marker detection sensor for locating the start position of an ink ribbon detects a Y start position maker (double markers for only Y) (S705). After the roll paper 512 is conveyed to the print start position and the start position of the Y ink ribbon is located, a platen roller 504, which has been retracted while paper is conveyed and the start position of the ink ribbon is located, comes into press contact with a thermal head 509 to sandwich the roll paper 512 and ink ribbon 505.

Image data is read out from the memory card 412, and the CPU 401 generates print data in a RAM 402. The CPU 401 transfers the generated print data to the driver IC of the thermal head 509. A heating element arranged in the thermal head 509 generates heat upon energization based on a head control signal. The ink ribbon is heated to transfer ink to the roll paper 512 in contact with the ink ribbon. The grip roller 503 feeds the paper in synchronism with energization processing of the thermal head 509. In this processing, printing is done on C-size seal paper. In this case, one image is transferred by conveying paper by a distance corresponding to 2,000 steps (S706). As a result, an image is printed in yellow (Y).

After the end of Y print processing, the platen roller 504 retracts, and the grip roller 503 is driven to rotate by a distance corresponding to 2,000 steps in a direction opposite to that in print processing. The roll paper 512 is fed back again to the print start position (S707).

Similar to S705, the roll bobbin 508 on the ink ribbon winding side winds the ink ribbon to detect an M ink ribbon marker and set the M ink ribbon to the start position (S708). Similar to S706, an image is printed with the M ink ribbon on the image formed in Y (S709). After printing in M, the roll paper 512 is fed back to the print start position, similar to S707 (S710).

C print processing in S711 to S713 is performed similarly to M print processing in S708 to S710. A cyan (C) image is printed on the images printed in Y and M.

Then, the start position of the OC layer of the ink ribbon is located (S714). By heat of the heating element of the thermal head 509, the resin clear layer (OC layer) forms a transparent protective layer on the images printed with the Y, M, and C inks. Print processing with the OC layer ends at a position where the paper is fed by a distance corresponding to 2,000 steps from the print start position (S715). By this processing, print processing of the first image data 1 is complete.

Since no cut setting is made between image data 1 and image data 2, no paper is cut in S608. Since no full-cut setting is made, no paper discharge operation is done in S609. Print processing has not ended for all image data (NO in S610), so the process shifts to print processing (S607) for the next image data 2.

In S607, paper is conveyed to the print start position for the next image data 2, similar to print processing for image data 1. Then, print processing is done for image data 2. Print processing of image data 2 is executed while image data 1 and image data 2 are adjacent to each other and their image ends are in contact with each other. The perforation cut setting is made between image data 2 and image data 3. Thus, after printing the image, the platen roller 504 retracts, and the grip roller 503 is driven to rotate in a direction opposite to that in printing. The roll paper 512 is fed back until the cutting position of the roll paper 512 reaches the position of a paper cutting mechanism 511. The paper cutting mechanism 511 of the printer apparatus perforates the roll paper 512 (S608). Since no full-cut setting is made, no paper discharge operation is performed in S609. Print processing has not ended for all image data (NO in S610), so the process shifts to print processing (S607) for image data 3.

In S607, print processing is done for image data 3, similar to print processing for image data 1. In the first embodiment, printing is executed while image data 2 and image data 3 are adjacent to each other and their image ends are in contact with each other. The half-cut setting is made between image data 3 and image data 4. Thus, after the end of printing, the platen roller 504 retracts, and the grip roller 503 is driven to rotate in a direction opposite to that in print processing. The roll paper 512 is fed back until the cutting position of the roll paper 512 reaches the position of the paper cutting mechanism 511. The paper cutting mechanism 511 of the printer apparatus performs half-cut processing to cut only the seal on the upper surface without cutting the release paper (S608). Since no full-cut setting is made, no paper discharge operation is performed in S609. Print processing has not ended for all image data (NO in S610), so the process shifts to print processing (S607) for image data 4.

In S607, print processing is done for image data 4, similar to print processing for image data 1. The full-cut setting is made between image data 4 and the next image data. Thus, after the end of printing, the platen roller 504 retracts. The grip roller 503 is driven to rotate in a direction opposite to that in printing to feed back the roll paper 512 until the cutting position of the roll paper 512 reaches the position of the paper cutting mechanism 511. The paper cutting mechanism 511 of the printer apparatus cuts the paper (S608).

Discharge rollers 507 pinch the cut paper, and are rotated in the discharge direction by the driving force of the stepping motor, discharging the printed paper from the printer apparatus (S609). If no print setting is made subsequently to image data 4 (YES in S610), the process ends. If image data is set subsequently, the same processing is repeated.

In this way, the printer apparatus provides the cut setting function. The printer apparatus cuts roll paper in accordance with a cut setting made with the cut setting function. The user can freely set a cutting position and cutting method.

Especially in a thermal printer, the printable area is determined in advance in accordance with the ink ribbon size, and paper is automatically cut in accordance with the printable area. However, according to the method of the first embodiment, the user can freely set a cutting position and cutting method.

In the first embodiment, image data printed on roll paper are in contact with each other. Alternatively, a blank area where no printing is done may also be interposed between image data to execute paper cut processing at the two ends of the image data via the blank. It is also possible to successively print a plurality of image data in print processing in S607 and execute paper cut processing after print processing. Among the above-described print processes, optimum processing may also be executed in accordance with the size of paper and the type and size of an ink ribbon. The size of the blank area other than the print area may also be changeable.

According to the first embodiment, when printing a plurality of images on roll paper, the user can easily select an image to be printed and set the cutting position and cutting method of roll paper. The first embodiment can reduce the operation burden on the user.

[Second Embodiment]

Print settings and print processing in a printer apparatus according to the second embodiment will be explained.

Figure 10:
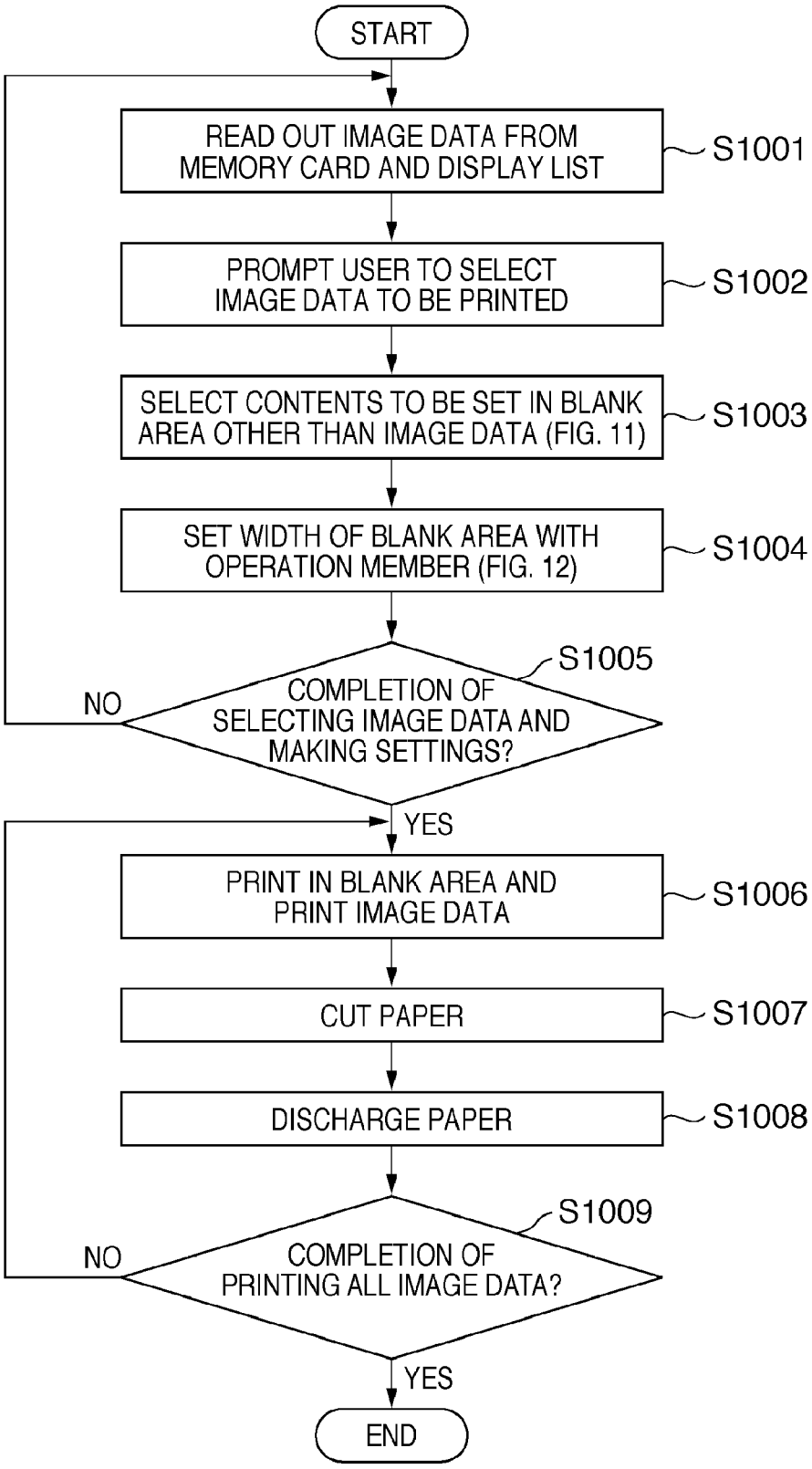
FIG. 10 is a flowchart showing print setting processing by a printer apparatus according to the second embodiment.
Figure 11:
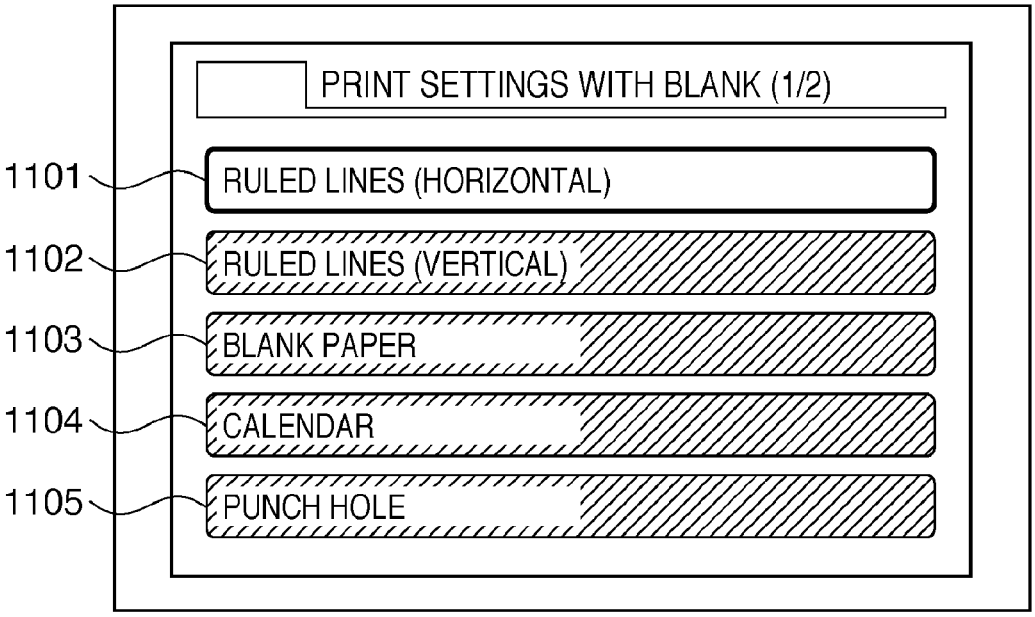
FIG. 11 is a view exemplifying a blank (non-image data) area setting window for printing with a blank on roll paper in the printer apparatus according to the second embodiment.
Figure 12:
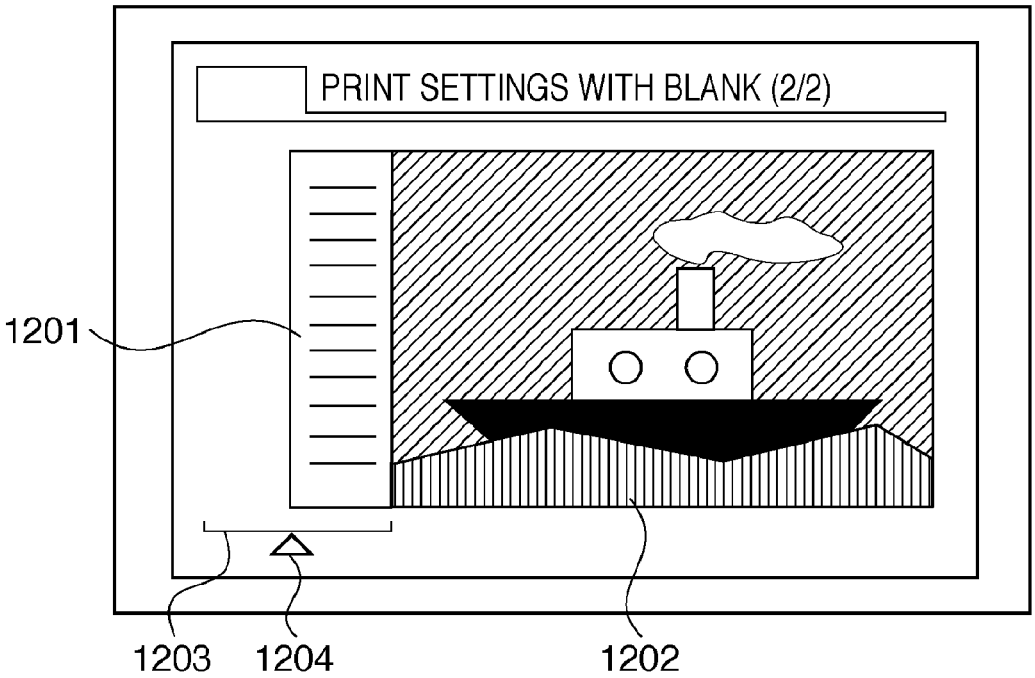
FIG. 12 is a view exemplifying a blank (non-image data) area width setting window for printing with a blank on roll paper in the printer apparatus according to the second embodiment.

FIG. 10 is a flowchart showing print processing by the printer apparatus according to the second embodiment. FIGS. 11 and 12 exemplify GUIs displayed on an LCD screen when executing processing shown in the flowchart of FIG. 10.

When the user selects "print settings with a blank" from the menu window of the GUI, image data is read out from a memory card 412. An LCD screen 411 displays a list of the thumbnails of image data (S1001).

By operating a four-way selector key 305 or jog dial 311 of the UI operation member, the user moves a selection cursor to select image data to be printed (S1002). The LCD displays a GUI as shown in FIG. 11. By pressing the up/down button of the four-way selector key 305, the user selects the contents of information to be printed in the blank area (S1003). When the user selects a ruled line (horizontal) setting button 1101, horizontal lines are printed in the blank area. When the user selects a ruled line (vertical) setting button 1102, vertical lines are printed in the blank area. When the user selects a blank paper setting button 1103, the blank area is output as a blank. When the user selects a calendar setting button 1104, the date of the calendar is printed in the blank area. When the user selects a punch hole setting button, a punching mark is printed in the blank area. By moving the cursor to a desired setting button and pressing the SET button 305, the user determines the selection of blank printing, and the display changes to a blank area setting window.

FIG. 12 shows a blank area setting window when ruled lines (horizontal) are set. A blank width setting cursor 1204 is scrolled right and left in accordance with an operation to the jog dial 311 of the UI operation member to change the blank area width (S1004). When the user presses the right/left button of the four-way selector key 305, the blank width setting cursor moves right and left by every predetermined amount. The blank width setting cursor 1204 can move within a blank area settable range 1203. The blank area settable range 1203 corresponds to the paper size and the ink ribbon size of each (color) layer. By pressing the SET button 305, the user sets the blank area width. The LCD may also display a GUI for determining the right or left end of image data at which the blank area is set. The blank area where nothing is printed may also be set over a range where a set of Y, M, C, and OC on the ink ribbon can print one image.

If there is another image data to be printed (NO in S1005), the same processing is repeated from S1001. Upon completion of setting the blank areas of all image data to be printed (YES in S1005), the user presses a print/stop button 306 to start printing.

Print processing is executed according to the flowchart of FIG. 7. More specifically, print data is generated by compositing data to be printed in the blank area and image data to be printed. Images corresponding to the generated print data, that is, a blank area (area where ruled lines or the like are printed without printing an image or nothing is printed) 1201, and an image data area 1202 are printed at once (S1006). After the end of printing, a platen roller 504 retracts, and a grip roller 503 is driven to rotate in a direction opposite to that in print processing. The number of steps of a pulse signal input to a stepping motor is adjusted in accordance with the blank area of roll paper 512 and the size of the image data area such that the cutting position reaches the position of a paper cutting mechanism 511. Then, the paper cutting mechanism 511 of the printer apparatus cuts the paper (S1007).

Discharge rollers 507 pinch the cut paper, and are rotated in the discharge direction by the driving force of the stepping motor, discharging the printed paper from the printer apparatus (S1008). If print processing has not ended for all the set image data (NO in S1009), the print processing is repeated from S1005. If print processing has ended for all the set image data (YES in S1009), the processing ends.

In the second embodiment, printing with a blank is set for each image data. It is also possible to make a setting according to the first embodiment, and display a print image for printing with a blank in a print image display window 103 for image data to be printed on roll paper.

According to the second embodiment, the user can set the width of a no-printing area and contents to be printed in the no-image data area.

[Third Embodiment]

Print settings and print processing in a printer apparatus according to the third embodiment will be explained.

Figure 13:
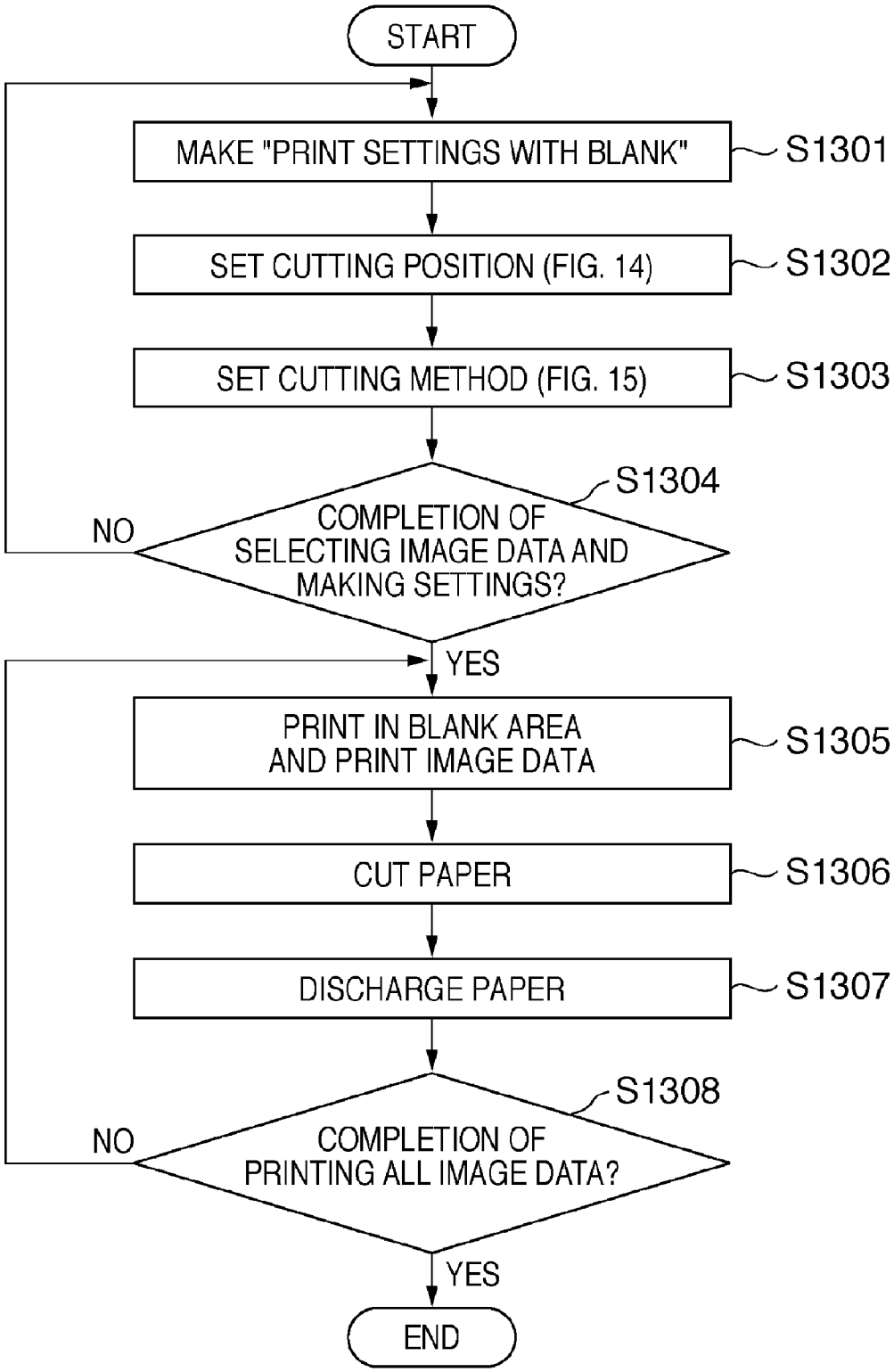
FIG. 13 is a flowchart showing print setting processing by a printer apparatus according to the third embodiment.
Figure 14:
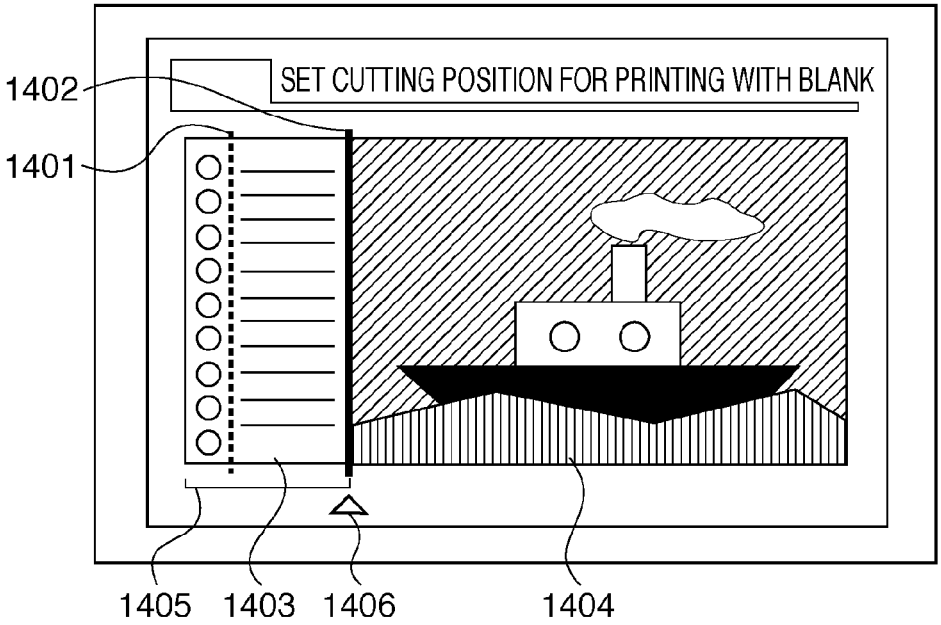
FIG. 14 is a view exemplifying a cutting position setting window for printing with a blank on roll paper in the printer apparatus according to the third embodiment.
Figure 15:
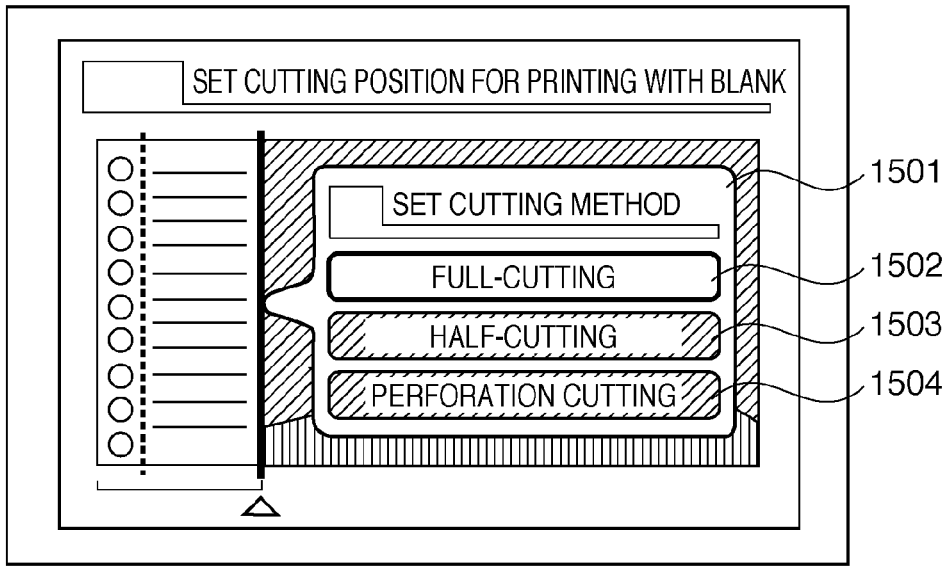
FIG. 15 is a view exemplifying a cutting method setting window for printing with a blank on roll paper in the printer apparatus according to the third embodiment.

FIG. 13 is a flowchart showing print processing by the printer apparatus according to the third embodiment. FIGS. 14 and 15 exemplify GUIs displayed on an LCD screen when executing processing shown in the flowchart of FIG. 13.

The user makes "print settings with a blank" from the menu window of the GUI, which has been described in the second embodiment (S1301). In the GUI of FIG. 14, a ruled line (horizontal) setting and punch hole mark setting are made. By rotating a jog dial 311, the user moves a cutting position setting cursor 1406 within a cutting position setting range 1405. When the user presses the right/left button of a four-way selector key 305, the cutting position setting cursor 1406 moves right and left by every predetermined amount. By this operation, the user moves the cutting position setting cursor 1406 to a cutting position he wants (S1302).

When the user presses the SET button 305 while the cutting position setting cursor 1406 is at the desired cutting position, a cutting method setting display window 1501 appears as represented by a GUI in FIG. 15. The cutting method setting display window 1501 displays a full-cut setting button 1502, half-cut setting button 1503, and perforation cut setting button 1504. The user presses the up/down button of the four-way selector key 305 to select a desired cutting method setting, and presses the SET button 305 to determine the cutting method (S1303). In the GUI of FIG. 14, the perforation cut setting and half-cut setting are made, and a perforation cut setting display 1401 and half-cut setting display 1402 are presented. If there is another image data to be printed (NO in S1304), the processing is repeated from S1301. Upon completion of selecting all image data to be printed and making settings (YES in S1304), the process shifts to print processing for the blank area and image data.

Print processing is executed according to the flowchart of FIG. 7 to print a blank (no-image data) area 1403 and image data area 1404 at once (S1305). After the end of print processing, a platen roller 504 retracts, and a grip roller 503 is driven to rotate in a direction opposite to that in print processing. The number of steps of a pulse signal input to a stepping motor is adjusted such that the cutting position set in S1302 and S1303 reaches the position of a paper cutting mechanism 511. According to the settings shown in the GUI of FIG. 14, upon completion of thermal transfer processing of the OC layer, roll paper 512 is fed back until the perforation cut setting position reaches the paper cutting mechanism 511. The paper cutting mechanism 511 perforates the roll paper 512. Then, the roll paper 512 is fed until the half-cut setting position reaches the paper cutting mechanism 511. The paper cutting mechanism 511 half-cuts the roll paper 512. Finally, the roll paper 512 is fed until the paper cutting position reaches the paper cutting mechanism 511. The paper cutting mechanism 511 cuts the roll paper 512 (S1306).

Discharge rollers 507 pinch the cut paper, and are rotated in the discharge direction by the driving force of the stepping motor, discharging the printed paper from the apparatus (S1307). If print processing has not ended for all the set image data (NO in S1308), the print processing is repeated from S1305. If print processing has ended for all the set image data (YES in S1308), the processing ends.

The third embodiment assumes a printer apparatus which uses roll paper, but is also applicable to a printer apparatus which uses cut sheets. In the third embodiment, printing with a blank is set for each image data. It is also possible to make a setting according to the first embodiment, display a print image for printing with a blank in a print image display window 103 for image data to be printed on roll paper, and execute print settings and print processing.

According to the third embodiment, the user can set the width of a no-image data area and contents to be printed in the no-image data area. In addition, the user can set an arbitrary half-cutting position or perforation cutting position in the no-image data area, improving user convenience.

[Fourth Embodiment]

Print settings and print processing in a printer apparatus according to the fourth embodiment will be explained.

Figure 16:
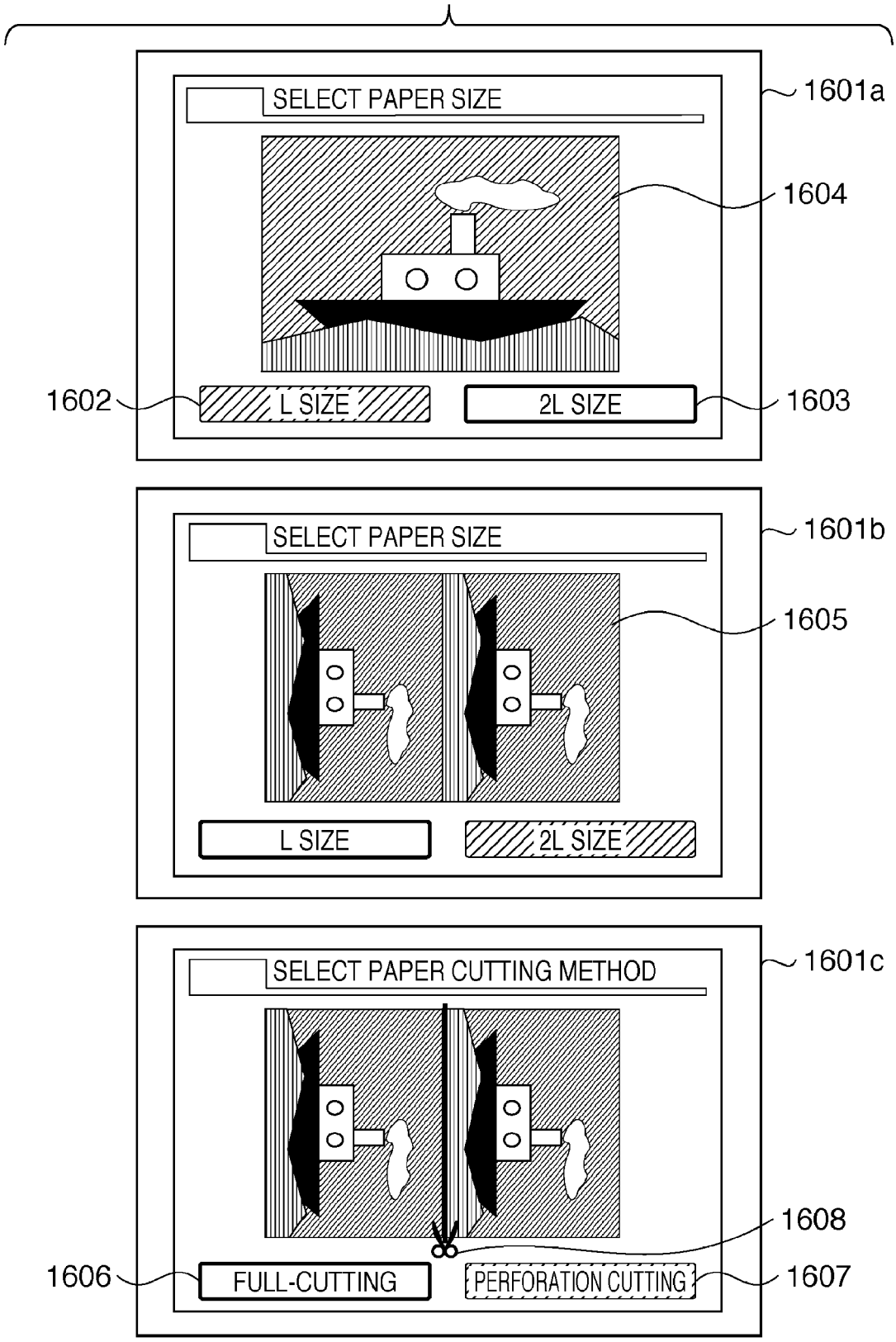
FIG. 16 is a view exemplifying a print setting window in a printer apparatus according to the fourth embodiment.

FIG. 16 exemplifies a GUI displayed on an LCD screen according to the fourth embodiment. The fourth embodiment provides a paper size setting method and paper cutting method in a printer which uses a 2L-size ink ribbon and roll paper.

When a cartridge which contains a 2L-size ink sheet is attached to a printer, the printer paper setting window allows the user to select the L size or 2L size, as represented by the paper size selection window in FIG. 16. When the user designates the 2L size, a 2L-size print image 1604 appears for confirmation. In response to press of a SET button 305, 2L-size print processing starts.

When the user designates the L size in the paper size selection window, a paper size selection window (upon selecting the L size) 1601*b* appears, and the user confirms an L-size print image 1605. In this case, a print image for printing two L-size images on 2L-size paper is displayed. In the paper size selection window (upon selecting the L size) 1601*b*, the same image data is set for two images, but different image data may also be set. When the user selects the L size, the window changes to a paper cutting method selection window 1601*c* after the user confirms the image. By pressing the right/left button of the four-way selector key 305 of the operation member, the user selects a full-cutting selection button 1606 or perforation cutting selection button 1607. In the paper cutting method selection window 1601*c*, full-cutting is selected, and a full-cut setting display 1608 appears at a cutting position on the L-size print image 1605. After selecting the cutting method, the user presses the SET button 305 to start print processing. Similar to the third embodiment, cut processing is executed at a predetermined position on paper in accordance with the cut setting after print processing.

According to the fourth embodiment, the user can select a paper size corresponding to an attached ink ribbon and a ½ paper size in accordance with the size of the ink ribbon attached to the printer. When the user selects the ½ paper size, paper is automatically cut at the ½ size. At this time, the user can also select a cutting method.

The fourth embodiment has explained only the 2L-size ink ribbon, but is also applicable to an ink ribbon of another size. It is also possible to attach a plurality of types of cartridges to the printer. In this case, the printer detects the type of attached ink cartridge, and the user can set a paper size corresponding to the detected type of cartridge and a ½ paper size. The printer may also allow the user to select a double paper size in addition to the ½ paper size.

In each embodiment, the GUI for making print settings is displayed on the LCD screen of the printer apparatus, and the operation member for making print settings is that of the printer apparatus. Instead, the GUI may also be displayed on the screen of a PC, and the operation member may also be an input device such as a keyboard.

[Other Embodiments]

The object of the present invention is also achieved by the following method. More specifically, a storage medium (or recording medium) which stores the program codes of software for implementing the functions of the above-described embodiments is supplied to a system or apparatus. The computer (or the CPU or MPU) of the system or apparatus reads out and executes the program codes stored in the storage medium. In this case, the program codes read out from the storage medium implement the functions of the above-described embodiments, and the storage medium which stores the program codes constitutes the present invention. The functions of the above-described embodiments are implemented when the computer executes the readout program codes. Also, the present invention includes the following case. More specifically, an operating system (OS) or the like running on the computer performs part or all of actual processing on the basis of the instructions of the program codes and thereby implements the functions of the above-described embodiments.

Further, the present invention includes the following case. More specifically, the program codes read out from the storage medium are written in the memory of a function expansion card inserted into the computer or the memory of a function expansion unit connected to the computer. Then, the CPU of the function expansion card or function expansion unit performs part or all of actual processing on the basis of the instructions of the program codes, thereby implementing the functions of the above-described embodiments.

When the present invention is applied to the storage medium, the storage medium stores program codes corresponding to the above-described sequences.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-143616, filed May 30, 2008, which is hereby incorporated by reference herein in its entirety.

What is claimed is:

1. A printing apparatus comprising:

an acquisition unit which acquires image data;

a print processing unit which prints an image on the roll paper based on the image data acquired by said acquisition unit;

a setting unit which sets a cutting position, said setting unit displaying an image to be printed on a display unit together with the cutting position, and changing the cutting position in accordance with an operation to an operation member, and a cutting unit which cuts the roll paper in accordance with the cutting position set by said setting unit, wherein said setting unit can set an outside of the image as the cutting position, and said print processing unit prints ruled lines in a blank area of the roll paper from the outside of the image to the cutting position when the cutting position is set to the outside of the image by said setting unit.

2. A print setting method in a printing apparatus, the method comprising:

an acquisition step of acquiring image data;

a setting step of displaying an image to be printed on a display unit together with a cutting position, and changing the cutting position in accordance with an operation to an operation member;

a print processing step of printing an image on the roll paper based on the acquired image data; and a cutting step of causing a cutting unit to cut the roll paper in accordance with the cutting position set in said setting step, wherein said setting step can set an outside of the image as the cutting position, and said print processing step prints ruled lines in a blank area of the roll paper from the outside of the image to the cutting position when the cutting position is set to the outside of the image in said setting step.

3. A printing apparatus comprising:

an acquisition unit which acquires image data;

a print processing unit which prints an image on the roll paper based on the image data acquired by said acquisition unit, wherein said print processing unit prints the image by automatically changing a size of the image such that a width of the roll paper corresponds to a width of the image;

a setting unit which sets a cutting position for cutting the roll paper in accordance with an operation to an operation member, and a cutting unit which cuts the roll paper in accordance with the cutting position set by said setting unit, wherein said setting unit can set an outside of the image as the cutting position, and said print processing unit prints ruled lines in a blank area of the roll paper from the outside of the image to the cutting position when the cutting position is set to the outside of the image by said setting unit.

4. The apparatus according to claim 3, further comprising a ruled line selecting unit which selects horizontal lines or vertical lines as the ruled lines to be printed in the blank area.

5. The apparatus according to claim 3, further comprising a blank area selecting unit which selects which end of the image the blank area is made.

6. The apparatus according to claim 3, wherein said print processing unit prints one image by sequentially transferring a set of a plurality of color inks to the roll paper from an ink ribbon cyclically coated with the plurality of color inks, and prints the ruled lines in the blank area when the cutting position is set from the outside of the image to an inside of an area which is printable by the set of the plurality of color inks.

7. The apparatus according to claim 3, further comprising a selecting unit which selects whether or not the ruled lines are printed in the blank area, said print processing unit does not print the ruled lines when no print of the ruled lines is selected by said selecting unit.

8. The apparatus according to claim 7, wherein said print processing unit prints one image by sequentially transferring a set of a plurality of color inks to the roll paper from an ink ribbon cyclically coated with the plurality of color inks, and said setting unit allows to set the cutting position within the area which is printable from the outside of the image by the set of the plurality of color inks.

9. The apparatus according to claim 8, wherein said setting unit allows to set an outside of the area which is printable by the set of the plurality of color inks as the cutting position when no print of the ruled lines is selected by said selecting unit.

10. A printing method comprising:

an acquisition step of acquiring image data;

a print processing step of printing an image on roll paper based on the image data acquired in said acquisition step, wherein the image is printed by automatically changing a size of the image such that a width of the roll paper corresponds to a width of the image;

a setting step of setting a cutting position for cutting the roll paper in accordance with an operation to an operation member; and a cutting step of cutting the roll paper in accordance with the cutting position set in said setting step, wherein said setting step can set an outside of the image as the cutting position, and said print processing step prints ruled lines in a blank area of the roll paper from the outside of the image to the cutting position when the cutting position is set to the outside of the image in said setting step.

11. A printing method according to claim 10, further comprising a ruled line selecting step of selecting horizontal lines or vertical lines as the ruled lines to be printed in the blank area.

12. A printing method according to claim 10, further comprising a blank area selecting step of selecting which end of the image the blank area is made.

13. A printing method according to claim 10, wherein said print processing step prints one image by sequentially transferring a set of a plurality of color inks to the roll paper from an ink ribbon cyclically coated with the plurality of color inks, and prints the ruled lines in the blank area when the cutting position is set from the outside of the image to an inside of an area which is printable by the set of the plurality of color inks.

14. A printing method according to claim 10, further comprising a selecting step of selecting whether or not the ruled lines are printed in the blank area, said print processing step not printing the ruled lines when no print of the ruled lines is selected in said selecting step.

15. A printing method according to claim 14, wherein said print processing step prints one image by sequentially transferring a set of a plurality of color inks to the roll paper from an ink ribbon cyclically coated with the plurality of color inks, and said setting step allows setting of the cutting position within the area which is printable from the outside of the image by the set of the plurality of color inks.

16. A printing method according to claim 15, wherein said setting step allows setting of an outside of the area which is printable by the set of the plurality of color inks as the cutting position when no print of the ruled lines is selected in said selecting step.

* * * * *